US006860221B1

(12) United States Patent
Henderson

(10) Patent No.: US 6,860,221 B1
(45) Date of Patent: Mar. 1, 2005

(54) TUBULAR BOAT HAVING MODULAR CONSTRUCTION

(76) Inventor: William C Henderson, 860 Coho Way #4, Bellingham, WA (US) 98225

( * ) Notice: Subject to any disclaimer, the term of this patent is extended or adjusted under 35 U.S.C. 154(b) by 0 days.

(21) Appl. No.: 10/334,479

(22) Filed: Dec. 31, 2002

(51) Int. Cl.[7] ..... B63B 7/04
(52) U.S. Cl. ..... 114/352; 114/364
(58) Field of Search ..... 114/123, 219, 114/266, 267, 283, 292, 343, 345, 352, 355, 357, 364, 68, 69, 360

(56) References Cited

U.S. PATENT DOCUMENTS

| | | | | | |
|---|---|---|---|---|---|
| 2,401,453 | A | * | 6/1946 | Bell et al. | 114/77 R |
| 2,959,146 | A | * | 11/1960 | Erkert | 114/219 |
| 3,109,405 | A | * | 11/1963 | Nusinoff | 114/219 |
| 4,287,624 | A | * | 9/1981 | Lowther | 114/343 |
| 4,807,556 | A | * | 2/1989 | Hillier | 114/345 |
| 5,184,566 | A | * | 2/1993 | Cochran | 114/355 |
| 5,803,007 | A | * | 9/1998 | Stevens | 114/266 |
| 5,878,685 | A | * | 3/1999 | Hemphill et al. | 114/219 |
| 6,178,911 | B1 | * | 1/2001 | Hemphill et al. | 114/345 |
| 6,371,040 | B1 | * | 4/2002 | Hemphill et al. | 114/219 |
| 6,619,224 | B1 | * | 9/2003 | Syfritt | 114/352 |

FOREIGN PATENT DOCUMENTS

| | | | | |
|---|---|---|---|---|
| DE | 102878 | * | 5/1899 | 114/123 |

* cited by examiner

*Primary Examiner*—Andrew D. Wright
(74) *Attorney, Agent, or Firm*—Todd N. Hathaway

(57) ABSTRACT

A rigid hull inflatable style boat constructed of rigid-shell modules. Modular gunwale sections are mounted to the trailing ends of a modular bow section to form the a flotation collar. Boats having greater/shorter lengths can be constructed by increasing or decreasing the number of gunwale modules. The bow and gunwale modules may be formed of molded polyethylene filled with hydrophobic foam material. The floor/hull module can be mounted at varying heights within the flotation collar to alter the performance characteristics of the craft. The hull module may have a V-shaped hydrodynamic contour, so that when the hull module is mounted relatively high within the collar the boat has a sponson-type hull form, and when the hull module is mounted relatively low within the flotation collar the boat has a V-type hull configuration. The flotation modules have a generally D-shaped configuration, with flat, vertically extending inboard walls that mate with a vertically-extending flange on the floor/hull module so that the latter can be adjusted to a higher or lower position within the collar during assembly.

33 Claims, 4 Drawing Sheets

TUBULAR BOAT HAVING MODULAR CONSTRUCTION

BACKGROUND OF THE INVENTION a. Field of the Invention

The present invention relates generally to boats having tubular flotation members and, more particularly, to a form of construction that allows tubular boats having a variety of lengths and configurations to be produced at reduced cost using modular components.

b. Background Art

Typically, small recreational boats are fabricated from fiberglass or aluminum in a rigid, open-hull configuration. The fiberglass versions generally require a dedicated mold designed specifically for each particular size and style of vessel. Because each mold is costly, and because the size of the molds requires a large facility for storage and production, the cost of producing a full line of boats which vary in size and configuration can quickly become exorbitant.

Traditional aluminum models face similar cost disadvantages. In some cases, the aluminum versions are hand fabricated using sheet metal forming and welding techniques. This is a costly, labor-intensive process that is usually only cost effective for custom boats. On the other hand, large-scale production requires large dedicated dies and jigs for forming and assembling the aluminum hull panels, resulting in cost and space requirements paralleling those associated with production of fiberglass boats using dedicated molds.

Regardless of materials and production methods, typical rigid, open-hulled boats have proven themselves effective for general recreational activities in calm waters. However, in more extreme conditions, such as shallow reefs and rocky coastlines, or during inclement weather conditions, these traditional configurations often lack the stability and seaworthiness necessary for safe operation, and in particular retain minimal buoyancy when swamped. In response, numerous manufactures have developed boats having a rigid hull inflatable (RHIB) configuration as a safer alternative for harsh or difficult environments and operations.

Generally, a rigid-hull inflatable boat derives buoyancy and stability from U-shaped tubular collar, in which the bight of the "U" forms the bow and the trailing portions form gunwales that extend rearwardly to a transom at the stern of the assembly. A rigid hull, nested within and attached to the U-shaped collar, provides a hydrodynamic running surface for the craft as well as a support platform for the occupants. An outboard motor attached to the transom typically provides propulsion.

Although a variety of collar configurations can be found in the prior art, the most common configuration employs a flexible pneumatic bladder that is inflated with air. In addition to being easily transportable, the popularity of this configuration sterns from reduced costs in manufacturing, in that it does not require the dedicated molds and related expenses associated with traditional, open-hulled boat production.

To prevent catastrophic failure in the event of a puncture, the pneumatic bladders on such boats are commonly compartmentalized to form two or more chambers. Although this adds a degree of safety, a bladder failure can still strand the occupants or significantly reduce travel speed, creating a situation that is inconvenient at best and life threatening at worst. To overcome this deficiency, a few manufacturers have developed an improved form of boat this is similar to rigid-hull inflatable boats in overall configuration, but in which the collar is formed as a rigid or semi-rigid shell which is filled with a low density, closed cell, foam core. In the event of a puncture the core material prevents water from entering the chamber, so that stability and mobility remain substantially unimpaired until repairs can be made.

While RHIB-style boats with foam filled collars are among the most robust and seaworthy craft available, prior versions have generally required dedicated molds for construction of the rigid collar thus incurring expenses and difficulties similar to those discussed with regard to the production of traditional, open hulled boats. As a result, the introduction of each new model having significant dimensional changes has required a new, expensive, dedicated mold, imposing a significant cost burden on the manufacturer and ultimately the consumer.

Moreover, because RHIB-style boats derive their stability from the buoyant collar, the rigid floor/hull is typically mounted relatively high within the collar, so that the collar gunwales act somewhat as pontoons. This provides a high degree of stability and a smooth ride on calm waters, however, in rough conditions this configuration tends to pound the waves, which is detrimental to both stability and passenger comfort. An alternative is to provide the craft with more of a V-shaped hull/floor unit and position it deeper with respect to the collar, which provides a smoother ride and better seaworthiness in rough conditions by cutting through the waves, but at the expense of rendering the craft more "tippy" and less maneuverable under calm water conditions.

As is apparent, the two hull configurations are physically at odds with each other, each excelling under certain conditions. Consequently, the consumer would like the option to purchase the hull configuration most applicable to boating requirements. Unfortunately, the types of constructions used in prior RHIB-style boats are unable to accommodate both configurations without doubling the number of models offered and assuming the financial penalties associated with the additional molds and tooling.

Accordingly, there exists a need for a safe, stable, and affordable boat that cannot deflate, collapse or sink like other boats found in the prior art. Furthermore, there exists a need for such a boat that can be easily configured during manufacture with variations in length and hull shape, thus accommodating a wide range of consumer applications. Still further, there exists a need for such a boat in which such variations in length and hull configuration can be accomplished without requiring additional dedicated molds or tooling, thus reducing the cost of producing a full line of boats.

SUMMARY OF THE INVENTION

The present invention has solved the problems cited above, and is an unsinkable, rigid hull, inflatable style boat which can be constructed in various configurations at reduced cost using modular components.

Broadly, the present invention comprises: a tubular, substantially rigid bow module having a forward end and first and second rearward ends; at least first and second tubular, substantially rigid, straight, modules mounted to the rearward ends of the bow module and extending rearwardly therefrom so as to form gunwale assemblies of the boat, the bow and gunwale modules in combination forming a flotation collar of the boat; and a substantially rigid hole member mounted within an interior area of the flotation collar formed by the bow and gunwale modules.

The gunwale assembly may comprise a plurality of the gunwale modules mounted in end-to-end relationship. The gunwale modules forming the gunwale assembly may each be substantially identical to one another.

The bow module may comprise a rigid or semi-rigid tubular collar structure formed in the general shape of a "U" or other contiguous form, such as a "V" for example, in which the bight of the collar structure forms the bow tip and the trailing ends extend rearwardly towards the stern of the boat. The trailing ends of the collar tube may be closed with end walls which seal the collar tube and provide a mating surface for connecting the gunwale modules thereto.

The tubular collar creates a sealed chamber which provides structural shape and buoyancy for the front of the boat. It also serves as a bumper element which absorbs impact upon contact with piling, other vessels or floating debris. The interior of the tubular collar may be filled with a core of low density, hydrophobic foam material. Because of the low density, the core material adds little weight that would decrease buoyancy, yet significantly increases the structural rigidity of the collar. In the event that the tubular collar becomes punctured, the core prevents water from entering the collar chamber and will not absorb water due to its hydrophobic nature. As a result, impact damage can occur with little loss of buoyancy, allowing the boat to remain fully operational and rendering it virtually unsinkable.

The tubular bow collar may be configured such that the portion of its cross-section defining the boat's interior wall is substantially straight and vertically oriented. This may be accomplished, for example, by using a tube structure having a substantially D-shaped cross-section in which the straight edge of the D is aligned vertically and faces towards the boat's interior. By this geometric arrangement, the peripheral front section of the hull element, which is configured to conformably mate with and connect to the interior wall of the bow module, may be disposed at any elevational position within the vertical extent of the interior wall height without requiring geometric alteration or generating voids at the joint interface with the collar. The elevational position of the hull element may be selected according to the intended application of the particular model being constructed and assembled accordingly. For instance if a shallow "V" configuration is desired, for greater stability and flat water comfort, the hull element may be raised with respect to the bow collar; or if a deep "V" hull is desired, for smoother travel in rough conditions, the hull may be lowered with respect to the bow collar.

The ability to alter the functional performance of the hull form without physically altering the hull structure provides a great advantage in terms of production cost. While traditional open hull boats and RHBs found in the prior art would require new, expensive molds, and/or major fabrication changes to accommodate such functional diversity, the present invention can accommodate such changes without modifying production procedures or incurring additional costs.

The gunwale modules provide an additional degree of production flexibility, by using the modules in essence as building blocks to construct boats of various lengths. Numerous consumer boating applications can therefore be satisfied while incurring little increase in production costs.

Each gunwale module may comprise an elongated, substantially linear rigid or semi-rigid tubular shell enclosed on either end by an end wall and again filled with a core of low density, hydrophobic foam material. In general, the material and function of the gunwale module's tubular shell and core may be respectively similar to that of the collar tube and core on the bow module. The cross-section of each sidewall module may also be similar to the bow collar, in that the cross-sectional portion defining the boat's interior wall may be substantially straight and vertically disposed. Again, by this geometric arrangement, the peripheral mid section of the hull, which is configured to conformably mate with and connect to the interior wall of the sidewalls, may be disposed at any elevational position within the vertical extent of the interior sidewall height without requiring geometric alteration or generating voids at the joint interface with the sidewalls.

The end walls of each sidewall module serve as mating surfaces for connecting the module to either a trailing end of the bow module or an axially adjacent gunwale module, as is appropriate. For a boat with minimal length requirements, each gunwale may comprise a single gunwale module. For longer boats, one or more additional gunwale modules may be added to each side so as to achieve the desired length. Although, from an economic standpoint, it is generally preferable to use a common length for each gunwale module and only produce boats in those incremental lengths, it is also possible vary the length of one or more modules to construct a boat of a specific length.

The transom module may comprise a typical transom structure which encloses the rear of the boat and provides a mounting surface for an outboard motor. As such, the transom module may comprise a rigid, substantially vertically oriented, laterally disposed plate. Each lateral end of the transom plate may be connected to the inside of the corresponding gunwale module and adjoining the sidewall's trailing end. A motor may be mounted, by conventional means, adjoining the upper edge of the transom plate.

The hull element may comprise a substantially horizontally disposed rigid structure configured with a peripheral shape that conforms to, and connects to, the enclosure defined by the inner walls of the bow module and sidewall modules of the collar and to the transom module. As previously discussed, by virtue of the substantial vertical orientation of inner walls of the module the assembled height of the hull element, with respect to the walls, can be easily varied in order to satisfy differing market and operational requirements.

Aside from the conforming peripheral shape, the hull element may incorporate any number of design features in order to achieve a particular performance goal as dictated by the intended function of the particular boat being constructed. For example, the hull element may be configured with a flat bottom, a V-bottom, a cathedral hull, or other suitable form. As a further example, the hull element may be constructed of a single structural layer in which the bottom surface provides a hydrodynamic running surface and the top surface supports the occupants, or the hull may comprise two layers in a clamshell configuration in which the lower layer acts as the running surface and the upper layer serves as a support deck for occupants.

In a preferred embodiment, the hull comprises a lower layer configured as a moderate V-hull, and an upper layer serving as the occupant support deck. The moderate "V"-hull constitutes a versatile configuration which may function effectively similar to a cathedral hull when the hull element is in a raised with respect to the flotation collar, and more as a deep "V"-hull when lowered position with respect to the flotation chambers.

The great advantage provided by the present invention is the significantly reduced cost of production enabled by the ability to produce a variety of boats which vary in length and functional characteristics without requiring an additional dedicated mold or tooling for each variation. An entire line of boat models can be produced from the same bow module, sidewall module, and transom module designs, each produced from a single dedicated mold. And, because the molds required for these individual components are significantly smaller than the massive molds required for conventional boat designs, the mold fabrication cost and the size of the facility for mold storage and boat production can be drastically reduced, even for a single model.

The invention, together with further aspects and advantages thereof, may be further understood by reference to the following detailed description and accompanying drawings.

DETAILED DESCRIPTION a. Overview

Figure 1:
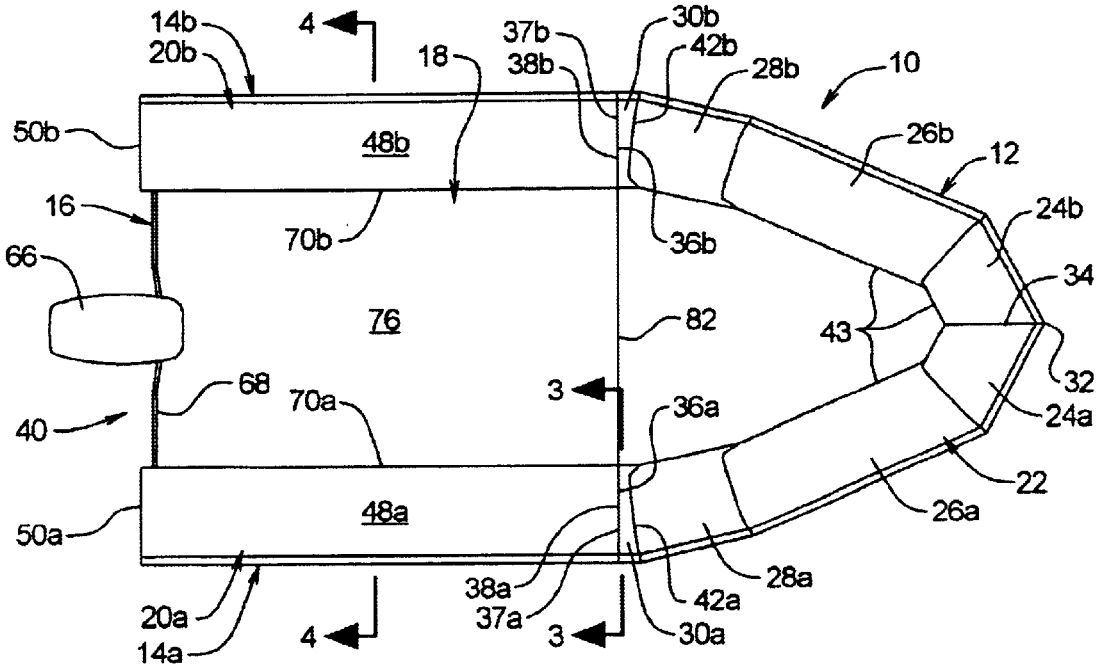
FIG. 1 is top, plan view of an modular boat assembly in accordance with the present invention, showing the manner in which the bow and gunwale modules are interconnected so as to form the flotation collar about the forward perimeter of the boat.
Figure 2:
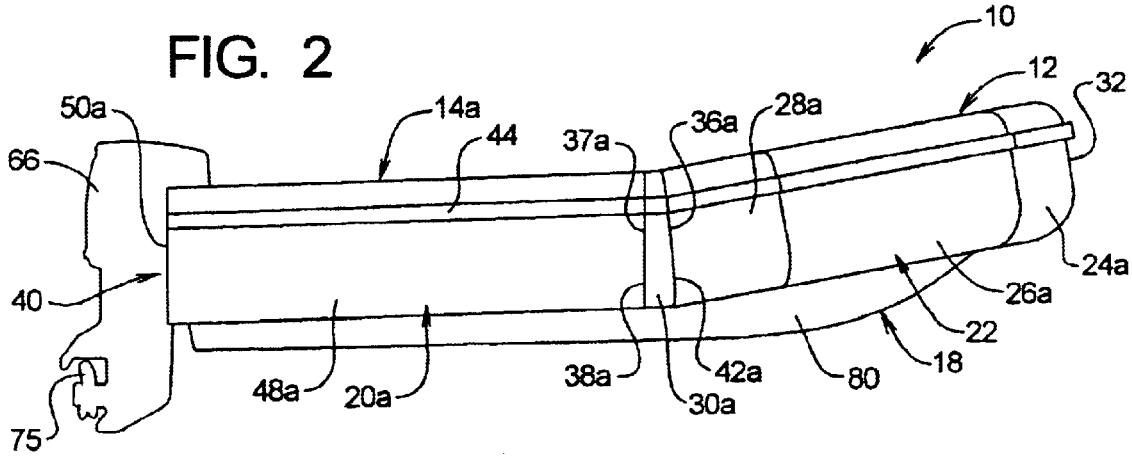
FIG. 2 is a side, elevational view of the modular boat assembly of FIG. 1, showing the manner in which the hull element protrudes downwardly below the flotation collar so as to form a hydrodynamic running surface for the boat.

FIG. 1 shows a top view, and FIG. 2 shows a side view of RHIB-style boat 10 in accordance with the present invention. As can be seen, the boat 10 includes four, interconnected modular assemblies, namely a bow assembly 12, right and left gunwale assemblies 14*a,b*, a transom unit 16, and a rigid floor/hull unit 18.

The identical bow assembly 12 and transom unit 16 may be used in all boats produced, regardless of length or hull configuration. In the embodiment illustrated in FIGS. 1 and 2, the gunwale assemblies 14*a,b* each comprise a single gunwale module 20*a,b* and thus define the limiting minimal length for the modular boat 10. For production of longer boats a lengthened version of the hull assembly 18 may be substituted, with additional gunwales modules connectively butted to the leading modules 20*a,b* to make up the difference in length. As will be described in greater detail below, the floor/hull unit 18 is then mounted to the bow and gunwale modules at a relatively higher or lower position within the collar assembly, depending on the intended use/application of the finished boat.

b. Bow Module

In the preferred embodiment illustrated in FIGS. 1–2, the bow assembly 12 comprises a rigid, thin-shelled collar structure 22 formed from a contiguous series of straight, tubular sections 24*a,b*–30*a,b* that interconnect to form a modified U-shaped bow when viewed in plan (see FIG. 1). The two forward tubular sections 24*a,b* join at an obtuse angle to form the stern 32 and define the bight of the "U" at their common interface 34. The two rearward sections 30*a,b*, in turn, are provided with flat, vertically disposed end panels 36*a,b* on their terminal ends, which seal the tubular collar 22 and define the trailing ends 37*a,b* of the "U"-shaped bow structure. The end panels 36*a,b* also provide mating surfaces for engaging corresponding end panels 38*a,b* on the gunwale modules 20*a,b*. Accordingly, the two collar end panels 36*a,b* lie in a common plane with a normal projection towards the stern 40 of the boat. The length of the bow module 12, from trailing ends 37*a,b* to stern 32, is suitably about 6 feet and the overall width is suitably about 7 feet, giving the boat an approximate 7-foot beam.

In profile, the bow module 12 is inclined such that the stern 32 is raised tightly with respect to the trailing ends 37*a,b* (see FIG. 2), providing the bow module with a degree of dead rise. This increases the stern height with respect to the waterline so that the boat rides more smoothly over waves and chop. The forward ends 42*a,b* of the rearward tubular sections 30*a,b*, in turn, are canted somewhat so as to provide a transition between the inclined forward portion of the bow and the horizontally disposed gunwale modules 20*a,b*. As can be seen, the trailing ends 37*a,b* of the bow tubes match the gunwale modules 20*a,b* in cross-section, so as to provide a smooth transition between modules when assembled.

Figure 3:
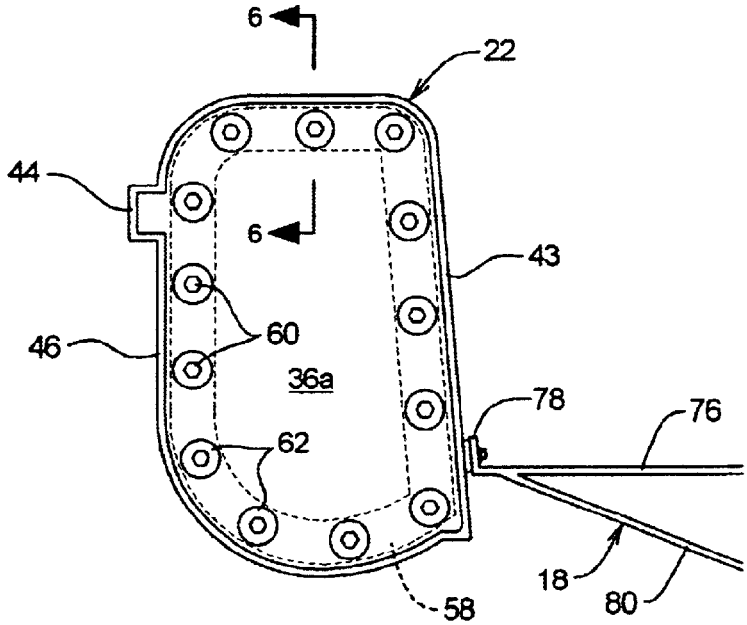
FIG. 3 is a cross-sectional view, taken along line 3—3 in FIG. 1, showing the bolted perimeter that forms the connection between the starboard gunwale module and the bow module of the boat assembly of FIG. 1.

Referring to FIG. 3, it can be seen that the tubular elements of the flotation collar 22 have a substantially "D"-shaped cross-section. Suitably, these have a width of about 12 inches, and a height of about 26 inches. The interior wall 43 forms the upright leg of the "D" and has a substantially vertical orientation which is maintained throughout the various tubular sections 24*a,b*–30*a,b*. As will be described in greater detail below, the flat, vertical interior walls allow the floor/hull unit 18 to be repositioned at different heights within the flotation collar 22 without requiring geometric alteration or causing voids at the interface therewith. This allows a variety of hull configurations to be produced to meet differing functional or consumer requirements. The generally rounded outboard walls of the modules, in turn, provide a smoothly contoured exterior that enhances hydrodynamic performance of the craft and also sheds water readily, while also providing a smooth, relatively comfortable surface for ingress/egress from the craft or for seating when in calm conditions. An optional rub rail 44 may be formed by a lateral protrusion in the outer wall 46, for protecting the outer surface of the floatation modules from abrasion and other damage during docking.

The exteriors of the tubular members forming the flotation collar 22 may be fabricated from any suitable rigid material such as fiberglass or aluminum for example, or a semi-rigid material such as molded polyethylene, polycarbonate, or other plastic material. In the illustrated embodiment, the collar shells are roto-molded as unitary structures from polyethylene nominally or typically ¼" thick. From a production standpoint, both this material and rotomolding process are extremely economical. In addition, polyethylene is tough and resilient, providing an impact resistant shell which tends to absorb the shock of impact rather than puncturing or cracking. In the rare event that the shell is punctured, molded polyethylene is easily and quickly repairable by conventional means.

An additional benefit derived from the use of a resilient, semi-rigid material such as polyethylene is that this provides adequate structural stiffness to maintain the shape of the boat while still having sufficient resilient compliance to allow it to be deformed somewhat without affecting the integrity of the structure. For instance, taking advantage of this characteristic, the beam portions of the bow module be deflected inwardly or outwardly when being mounted to floor/hull units having different widths, so that a single bow module can be used to construct boats having slightly different beams. Similarly, resilient compliance of the collar allows it to accommodate slight mismatches in fit, further reducing the cost of manufacture.

As previously discussed, the interior of the tubular collar 22 is preferably filled with a core of low density, hydrophobic material that prevents the intrusion of water and maintains buoyancy in the event of a puncture. In the illustrated embodiment, the core is suitably formed of a conventional two-part polyurethane foam that is mixed and injected through sealable orifices in the collar tubes. The mixture expands by chemical reaction and solidifies, forming a rigid, impermeable core. Although this material and process is preferred for its ease of production, other low density, hydrophobic materials, such as polyethylene foam, expanded polystyrene beads or other materials with similar characteristics may also be used.

The preceding description of the bow module 12 has been made primarily with respect to the U-shaped configuration of the preferred embodiment. It is noted however, that other geometric forms, variations, and cross-sections may be implemented in accordance with the essence of the invention.

c. Gunwale Modules

Figure 4:
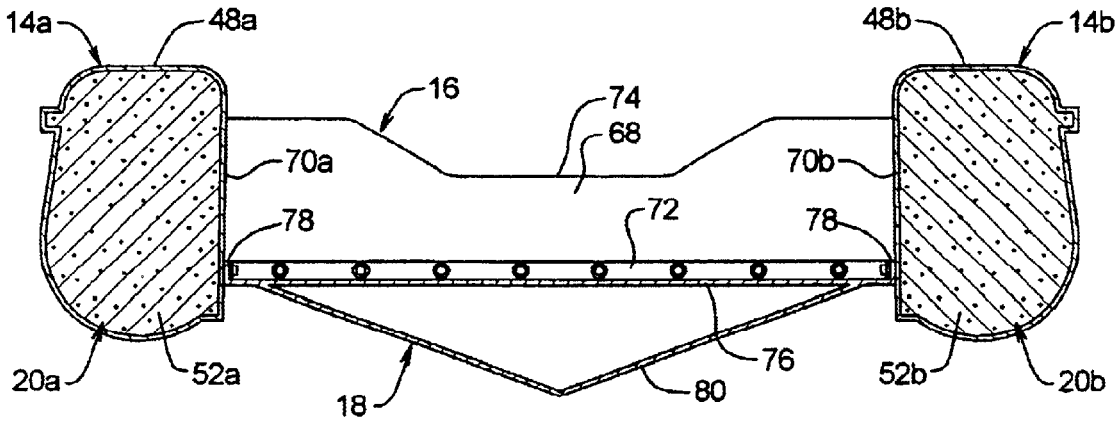
FIG. 4 is a cross-sectional view, taken along line 4—4 in FIG. 1, showing the relationship between the rigid hull element and the planar, vertically extending inner walls of the gunwale modules boat assembly of FIG. 1.

As noted above, each gunwale (side) of the boat is formed by one or more modules 20*a,b*. The gunwale modules thus serve as "building blocks" for producing boats of various lengths. As can be seen in FIG. 4 and also FIGS. 1–2, in the preferred embodiment each gunwale module comprises an elongate tubular shell 48*a,b* that is configured to extend horizontally and lengthwise along the side of the boat 10. The forward and rearward ends of the tubular shells are provided with end panels 38*a,b* and 50*a,b*, each of which comprises a substantially flat, vertically oriented wall having a normal projection extending generally parallel to the centerline of the boat. The end panels seal the ends of the tubular shells 48*a,b* and also provide mating surfaces for connection to the end panels on adjoining gunwale modules.

The material used for the shells 48*a,b* of the gunwale modules 20*a,b*, as well as the cross-sectional shape and method of manufacture, are substantially the same as those discussed above with respect to the bow assembly, and the shells are likewise filled with a core 52*a,b* of hydrophobic foam material. However, it will again be understood that other geometric configurations, materials, and construction methods may be used in other embodiments of the invention.

Figure 7:
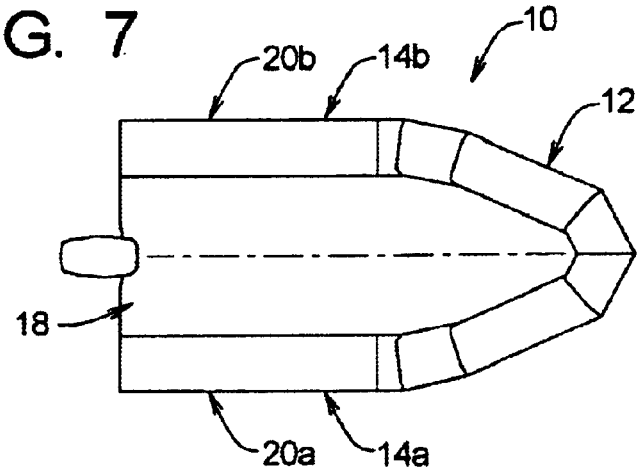
FIGS. 7–9 are sequential, plan views of a boat assembly similar to that of FIG. 1, showing the manner in which additional gunwale modules are readily installed to construct a boat of greater length without requiring an additional mold or dedicated components.
Figure 8:
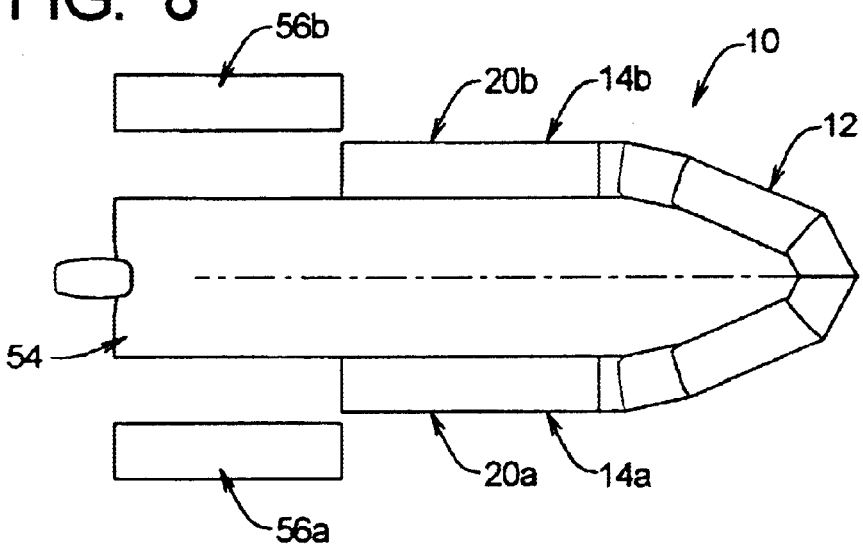
Figure 9:
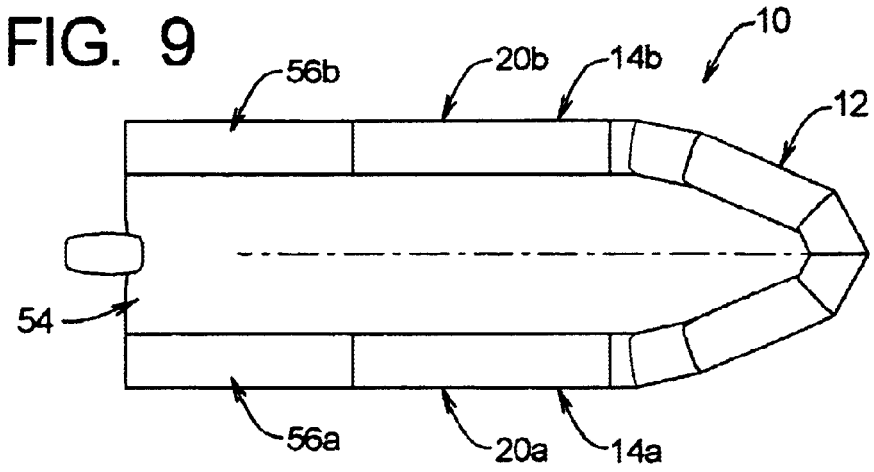

In the illustrated embodiment, the gunwale modules 20*a,b* are approximately 5 feet long, allowing boats to be produced in incremental lengths of 5 feet. For example, referring to FIG. 7, assuming the bow module 12 to be 6 foot in length, an 11 foot boat can be produced using a single 5-foot gunwale module 20*a,b* for each gunwale assembly. By connecting an additional 5-foot module 56*a,b* as shown in FIGS. 8–9 and using a longer float/hull unit, a 16-foot boat can be produced. Adding another pair of gunwale modules produces a 26-foot boat, and so on.

The gunwale modules 20 are all substantially identical, i.e., they have the same length, are symmetrical lengthwise, and possess a uniform cross-section over their entire length. The same modules can therefore be used to construct all sections of the right and left flotation gunwales 14*a,b* regardless of the length of the boat. This a great advantage in terms of production costs, since gunwale modules for all models of boat can be produced from a single, compact and inexpensive mold.

It will be understood that although a consistent 5-foot sidewall module is exemplified in the preferred embodiment, this length and configuration is not meant to be restrictive in any way. Other embodiments may utilize sidewall modules having other lengths to produce boats in other incremental lengths. In addition, it may be desirable in some circumstances to sacrifice the advantages of a single mold and produce sidewall modules which are not necessarily identical in length or cross-section. For instance, to produce a boat having a particular boat length it may be necessary to produce a gunwale module that is somewhat truncated or extended or it may be desirable for aesthetic or operational reasons to produce a special end module which mounts at the tail end of the gunwale assembly to provide a contoured aspect or finished appearance.

Figure 6:
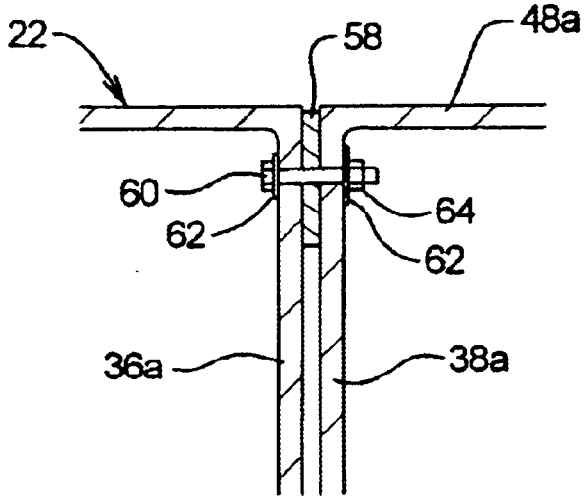
FIG. 6 is a cross-sectional view, taken along line 6—6 in FIG. 3, showing the connection between the starboard gunwale module and the bow module of the modular boat assembly of FIG. 1 showing one of the bolts that forms the connection between the modules and the gasket member that is interposed between the end walls of the modules.

A variety of conventional means, such as welding, adhesives or mechanical fasteners, for example, may be used to form the connection between longitudinally adjoining gunwale modules 20*a,b*, or between the gunwale modules and the trailing ends 37*a,b* of the bow assembly 12. In the preferred embodiment, a bolted connection is used, as shown in FIGS. 3 and 6. Because, as noted above, the bow collar 22 and gunwale shell 48*a* share cross-sectional shapes and dimensions at the joint interface, their respective end panels 36*a*, 38*a* can be butted face-to-face to form a connection having a smooth, substantially continuous exterior surface. Prior to mating, a sealant 58, such as a polybutyl rubber tape, is preferably applied about the periphery of the joint faces to create a watertight barrier. A plurality of bolts 60 fitted with washers 62 are inserted through bores around the perimeters of the end panels 36*a*, 38*a*, and then secured using additional washers 62 and nuts 64. Any voids that may be created by a mismatch or warpage of the panels are eliminated by the fastener pressure and the sealant 58; any sealant which extrudes from the joint as it is compressed is subsequently trimmed away during the finishing process.

As can be seen, a comparatively large number (e.g., 13) of bolts are used to form the connection, and the bolts are preferably positioned relatively close to the perimeters of the panels so that a plurality of bolts run along the top and bottom edges of the panels as well as the inboard and outboard edges. This arrangement provides a strong, durable joint, both by reducing the lever arm of bending forces acting on the joint and by distributing the forces out into the polyethylene or other material in a comparatively even manner.

Although other mechanical fasteners, such as rivets, may be substituted, it is generally preferable to use removable fasteners such as those described, so that a severely damaged gunwale or bow module can be easily replaced if necessary. Furthermore, while fastener hardware made of stainless steel is generally preferred in a marine environment, it will be noted that in the present invention the fastening hardware is protected from exposure by the watertight walls and foam cores of the modules, so that production costs can be reduced by using fastening hardware made of mild steel or other less expensive materials without sacrificing durability or structural integrity.

d. Transom Unit

Referring to FIG. 1 and FIG. 4, the transom unit 16 encloses the stern 40 of the boat 10 and provides a mounting/support structure for an outboard motor 66.

Accordingly, in the preferred embodiment the transom unit comprises a rigid, substantially vertically disposed rectangular plate 68 that extends laterally across the stern 40 of the boat and is mounted to the inner walls 70*a,b* of the left and right gunwale assemblies 14*a,b* using fasteners and a sealant. As can be seen in FIG. 4, the trailing end 72 of the hull unit 18, in turn, is mounted to the inside surface of the transom plate proximate its bottom edge.

A cutaway 74 in the top edge of the transom plate provides a recess for mounting the motor 66 and ensures that the propeller 75 extends to an adequate depth in the water.

The transom plate may suitably be constructed from any of a variety of suitable marine grade materials, such as fiberglass, aluminum, or plywood, which provide adequate strength and stiffness to support the thrust generated by the motor 66.

e. Floor/Hull Unit

The floor/hull unit 18 comprises a rigid, somewhat planar structure having a peripheral shape that conforms to the enclosure defined by the bow and gunwale assemblies 22,14 and the transom plate 68.

Figure 5:
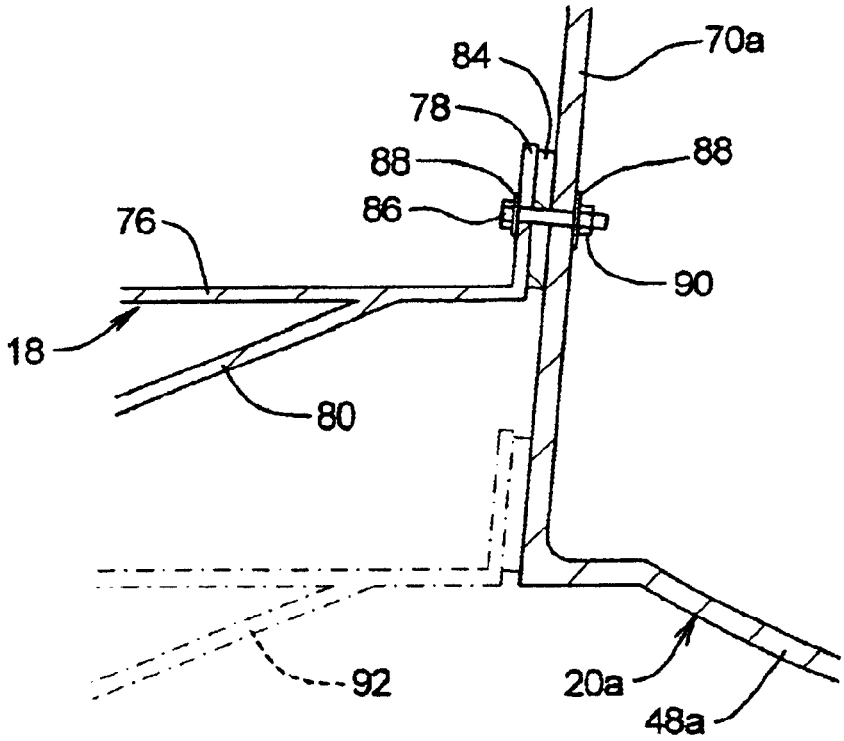
FIG. 5 is a cross-sectional view, showing the connection between the hull element and the starboard gunwale module of the modular boat assembly of FIG. 1, and illustrating the manner in which the hull element is readily mountable at varying heights relative to the modular flotation collar without requiring modification of the components.

As can be seen in FIG. 4, in the preferred embodiment the floor/hull unit is formed by upper and lower aluminum panels 76, 80 that are joined in a somewhat clamshell fashion along their peripheral edges by welding or other suitable means. The upper panel 76 serves as a support deck for the occupants and comprises a generally flat, horizontally disposed sheet which is bent upwardly along a transverse fold 82 (see FIG. 1) to follow the incline of the bow assembly 12. Substantially continuous, upturned flanges 78 are formed along the edges of the deck panel and conform to the vertically extending inside walls of the tubular modules, to which the flanges are mounted by a series of spaced, bolted connections. FIG. 5 shows one of the bolted connections, formed between the hull unit and a gunwale module 20*a*.

As can be seen in FIG. 5, a strip of sealant material 84, such as polybutyl rubber tape, is applied to the interface between the flange 78 and the inside wall 70*a* of the flotation shell. The sealant material 84 fills any small voids in the joint and ensures that a watertight seal is established. A bolt 86 fitted with a washer 88 is inserted through cooperating bores in the flange 78 and wall 70*a*, and then secured using another additional washer 88 and a nut 90. Any slight voids produced by mismatches in the joint are eliminated by the fastener pressure and the deformable sealant 84.

In the preferred embodiment the fastening hardware joining the floor/hull unit to the flotation collar is preferably made of stainless steel in order to eliminate galvanic interaction with the aluminum hull unit, as well as to avoid corrosion due to salt water exposure. Although other connective means, such as adhesives, welds, or rivets, may be substituted, it is generally preferable to use removable fasteners, in order to allow a damaged module or floor/hull unit to be removed and replaced if necessary.

The lower panel 80 of the floor/hull unit 18 serves as a hydrodynamic running surface and largely governs the performance characteristics of the boat. In the illustrated embodiment, the running surface 80 is configured as a moderate V-hull, and, as can be seen in FIG. 2, the "V"-shaped surface sweeps upwardly towards the stern of the craft so as to provide satisfactory ride through waves and chop. As noted above, a particular benefit of the present invention is the ability to mount the floor/hull unit 18 higher or lower within the flotation collar during production in order to achieve different performance characteristics; the moderate V-hull is advantageous in this regard, in that it is able to form either a V-type hull or a sponson-type hull, depending on its assembled height.

The flat, vertical configuration of the interior walls of the bow and gunwale modules allow the floor/hull unit 18 can be positioned and attached at any of a wide range of locations along the vertical extent of the walls. As shown by the solid line representation in FIG. 5, a sponson-type hull configuration can be achieved by mounting the floor/hull unit 18 relatively high on the interior walls 70, so that the lower edges of the gunwale assemblies extend further downward relative to the V-shaped running surface; In this configuration the boat delivers greater stability and flat-water comfort. Alternatively, mounting the floor/hull unit 18 at a lower elevation with respect to the interior walls 70, as illustrated by the dashed line representation 92 in FIG. 5, achieves more of a V-type hull configuration, providing smoother ride and greater seaworthiness in rough conditions. These diverse performance characteristics can thus be achieved without requiring structural modifications to the components or altering production/assembly procedures. To accommodate models having different lengths, the floor/hull unit 18 can simply be produced in a variety of corresponding lengths by simply increasing the length of the trailing portion of the unit while maintaining the same cross-section and peripheral configuration.

Although the moderate V-hull floor/hull unit is used in the preferred embodiment for its functional diversity, a variety of other hull shapes and features may be employed to achieve particular performance goals. In the illustrated embodiment, the floor/hull unit 18 as suitably fabricated from aluminum sheet which is joined by welding; however, other materials having adequate structural stiffness, strength and corrosion resistance may be used. For example, the hull unit may be molded from fiberglass, or roto-molded from polyethylene material similar to that used to create the bow collar and gunwale shells.

It is to be recognized that various alterations, modifications, and/or additions may be introduced into the constructions and arrangements of parts described above without departing from the spirit or ambit of the present invention as defined by the appended claims.

What is claimed is:

1. A rigid hull inflatable style boat, comprising:

a tubular, non-inflatable, rigid-shelled bow flotation module having a forward end and first and second rearward ends;

at least first and second tubular, non-inflatable, rigid-shelled, straight gunwale flotation modules mounted to said rearward ends of said bow flotation module and extending rearwardly therefrom so as to form gunwale assemblies of said boat;

said ends of said rigid shelled bow and gunwale flotation modules each comprising rigid end walls for mounting to corresponding end walls of adjoining flotation modules in load-bearing engagement therewith, said bow and gunwale flotation modules in combination forming a flotation collar of said boat; and a substantially rigid hull member mounted within an interior area of said flotation collar formed by said bow and gunwale flotation modules.

2. The boat of claim 1, wherein each said gunwale assembly comprises:

a plurality of said gunwale flotation modules mounted in end-to-end relationship.

3. The boat of claim 1, wherein said gunwale flotation modules are substantially identical to one another.

4. The boat of claim 1, wherein each of said gunwale flotation modules comprises:

an elongate rigid shell having first and second ends; and a lightweight core enclosed within an interior of said rigid shell.

5. The boat of claim 4, wherein said bow flotation module comprises:

a generally U-shaped rigid shell having a bow area and first and second trailing ends; and a lightweight core enclosed within an interior of said rigid shell.

6. The boat of claim 5, wherein each of said end walls comprises a substantially flat panel that bears against an adjoining mating surface in face-to-face engagement.

7. The boat of claim 6, further comprising:

a plurality of fasteners extending through said flat panels so as to secure said mating surfaces in face-to-face engagement.

8. The boat of claim 7, wherein said fasteners extend through said panels around peripheral borders thereof so as to secure said panels together against longitudinal bending loads exerted on said boat.

9. The boat of claim 4, wherein said hull member comprises:

a bottom hull surface having a hydrodynamic configuration.

10. The boat of claim 9, wherein each of said gunwale flotation modules has generally D-shaped cross-section comprising:

a curved outboard wall portion facing outwardly along a side of said boat; and a substantially flat, vertically extending inboard wall portion facing inwardly towards said interior area of said flotation collar.

11. The boat of claim 10, wherein said hull member further comprises:

means for mounting said hull member at variable levels relative to said flotation collar during assembly.

12. The boat of claim 11, wherein said means for mounting said hull member at variable levels relative to said flotation collar comprises:

substantially vertically extending flange portions on first and second side edges of said hull member for engaging said vertically extending inboard wall portions of said shells of said gunwale flotation modules at variable heights relative to said modules.

13. The boat of claim 12, wherein said hull member is mounted relatively higher on said gunwale flotation modules so that said boat has a generally sponson-type hull form.

14. The boat of claim 12, wherein said hull member is mounted relatively lower on said gunwale modules so that said boat has a generally V-type hull configuration.

15. The boat of claim 10, wherein said hydrodynamic configuration of said bottom hull surface is a substantially V-shaped configuration.

16. A method of constructing a rigid hull inflatable style boat, comprising:

forming a tubular, non-inflatable, rigid-shelled bow flotation module having a forward end and first and second rearward ends;

forming a plurality of tubular, non-inflatable, rigid-shelled, straight gunwale flotation modules;

mounting at least one of said gunwale flotation modules to each of said rearward ends of said bow flotation module so that said gunwale flotation modules extend rearwardly therefrom so as to form gunwale assemblies of said boat;

said ends of said rigid shelled bow and gunwale flotation modules each comprising rigid end walls for mounting to corresponding end walls of adjoining flotation modules in load-bearing engagement therewith, said bow and gunwale flotation modules in combination forming a flotation collar of said boat; and mounting a substantially rigid hull member within an interior area of said flotation collar formed by said bow and gunwale flotation modules.

17. The method of claim 16, wherein the step of mounting said gunwale flotation modules to said bow flotation module comprises:

mounting a plurality of said modules in end-to-end relationship so as to form said gunwale assemblies.

18. The method of claim 17, wherein the step of forming said hull member comprises:

forming said hull member with a bottom hull surface having a hydrodynamic configuration.

19. The method of claim 18, wherein the step of mounting said hull member to said flotation collar comprises:

mounting said hull member to said flotation collar at variable levels relative to said collar during assembly.

20. The method of claim 19, wherein the step of forming said hull members with a bottom hull surface having a hydrodynamic configuration comprises forming said bottom hull surface to have a substantially V-shaped configuration.

21. The method of claim 16, wherein the step of forming said gunwale flotation modules comprises:

forming each of said gunwale flotation modules to have a substantially identical configuration.

22. The method of claim 21, wherein the step of forming said gunwale flotation modules further comprises:

forming each of said gunwale flotation modules to have a generally D-shaped cross-section comprising a curved outboard wall portion for facing outwardly along a side of said boat, and a substantially flat, vertically extending inboard wall portion for facing inwardly towards said interior area of said flotation collar.

23. The method of claim 22, wherein the step of forming said hull member comprises:

forming said hull member with substantially vertically extending flange portions on first and second side edges of said hull member for engaging said vertical inboard wall portions of said gunwale flotation modules at variable heights relative to said flotation modules.

24. The method of claim 23, wherein the step of mounting said hull member to said flotation collar comprises:

mounting said hull member relatively higher on said gunwale flotation modules so that said boat has a generally sponson-type hull form.

25. The method of claim 23, wherein the step of mounting said hull member to said flotation collar comprises:

mounting said hull member relatively lower on said gunwale flotation modules so that said boat has a generally V-type hull form.

26. A rigid hull inflatable style boat, comprising:

a tubular, substantially rigid bow module having a forward end and first and second rearward ends, said bow module comprising:

a generally U-shaped rigid shell having a bow area and first and second trailing ends and a lightweight core that is enclosed within an interior of said shell;

at least first and second tubular, substantially rigid, straight gunwale modules mounted to said rearward ends of said bow module and extending rearwardly therefrom so as to form gunwale assemblies of said boat, each of said gunwale modules comprising:

an elongate rigid shell having first and second ends and a lightweight core that is enclosed within an interior of said shell;

said ends of said rigid shells of said bow and gunwale modules comprising surfaces for mounting to corresponding mating surfaces on ends of adjoining modules in load-bearing engagement therewith, each of said surfaces comprising a substantially flat panel that bears against an adjoining mating surface in face-to-face engagement, a plurality of fasteners extending through said flat panels so as to secure said mating surfaces in face-to-face engagement; and said bow and gunwale modules in combination forming a flotation collar of said boat;

a substantially rigid hull member mounted within an interior area of said flotation collar formed by said bow and gunwale modules.

27. The boat of claim 26, wherein said fasteners extend through said panels around peripheral borders thereof so as to secure said panels together against longitudinal bending loads exerted on said boat.

28. A rigid hull inflatable style boat, comprising:

a tubular, substantially rigid bow module having a forward end and first and second rearward ends;

at least first and second tubular, substantially rigid, straight gunwale modules mounted to said rearward ends of said bow module and extending rearwardly therefrom so as to form gunwale assemblies of said boat, each of said gunwale modules comprising an elongate rigid shell having first and second ends and a lightweight core that is enclosed within an interior of said shell;

said bow and gunwale modules in combination forming a flotation collar of said boat, each of said gunwale modules having a generally D-shaped cross-section comprising a curved outboard wall portion facing outwardly along a side of said boat; and a substantially flat, vertically extending inboard wall portion facing inwardly towards said interior area of said flotation collar;

a substantially rigid hull member mounted within an interior area of said flotation collar formed by said bow and gunwale modules, said hull member comprising a bottom hull surface having a hydrodynamic configuration; and means for mounting said hull member at variable levels relative to said flotation collar during assembly, said means for mounting said hull member at variable levels relative to said flotation collar comprising substantially vertically extending flange portions on first and second side edges of said hull member for engaging said vertically extending inboard wall portions of said shells of said gunwale modules at variable heights relative to said modules.

29. The boat of claim 28, wherein said hull member is mounted relatively higher on said gunwale modules so that said boat has a generally sponson-type hull form.

30. The boat of claim 28, wherein said hull member is mounted relatively lower on said gunwale modules so that said boat has a generally V-type hull configuration.

31. A method of constructing a rigid hull inflatable style boat, comprising:

forming a tubular, substantially rigid bow module having a forward end and first and second rearward ends;

forming a plurality of tubular, substantially rigid, straight gunwale modules, each of said gunwale modules having a substantially identical configuration with a generally D-shaped cross-section comprising a curved outboard wall portion for facing outwardly along a side of said boat, and a substantially flat, vertically extending inboard wall portion for facing inwardly towards said interior area of said flotation collar;

mounting at least one of said gunwale modules to each of said rearward ends of sad bow module so that said gunwale modules extend rearwardly therefrom so as to form gunwale assemblies of said boat;

said bow and gunwale modules in combination forming a flotation collar of said boat;

forming a substantially rigid hull member comprising substantially vertically extending flange portions on first and second side edges of said hull member for engaging said vertical inboard wall portions of said gunwale modules at variable heights relative to said modules; and mounting said substantially rigid hull member within an interior area of said flotation collar formed by said bow and gunwale modules.

32. The method of claim 31, wherein the step of mounting said hull member to said flotation collar comprises:

mounting said hull member relatively higher on said gunwale modules so that said boat has a generally sponson-type hull form.

33. The method of claim 31, wherein the step of mounting said hull member to said flotation collar comprises:

mounting said hull member relatively lower on said gunwale modules so that said boat has a generally V-type hull form.

* * * * *